US005899344A

United States Patent [19]

Current et al.

[11] Patent Number: 5,899,344

[45] Date of Patent: May 4, 1999

[54] EXTRUDED SLATWALL SECTION AND METHOD FOR MAKING THE SAME

[75] Inventors: Wayne A. Current, Holmdel, N.J.; John D. Maxworthy, N. Merrick, N.Y.

[73] Assignee: International Visual Corporation, Port Washington, N.Y.

[21] Appl. No.: 08/789,272

[22] Filed: Jan. 28, 1997

Related U.S. Application Data

[63] Continuation-in-part of application No. 08/726,161, Oct. 4, 1996.

[51] Int. Cl.[6] ..... A47F 5/08

[52] U.S. Cl. ..... 211/94.01; 264/45.5; 264/45.9; 264/132

[58] Field of Search ..... 264/132, 45.9, 264/45.5; 211/94.02, 94.01

[56] References Cited

U.S. PATENT DOCUMENTS

| | | | |
|---|---|---|---|
| D. 338,076 | 8/1993 | Current | D25/123 |
| 3,712,590 | 1/1973 | Tochner et al. | 256/34 |
| 4,607,753 | 8/1986 | Radek | 211/87 |
| 4,938,366 | 7/1990 | Carroll | 211/94.02 |
| 4,961,295 | 10/1990 | Kosch, Sr. et al. | 211/94.02 |
| 5,138,803 | 8/1992 | Grossen | 211/94.01 |
| 5,573,054 | 11/1996 | Swopes | 160/236 |

FOREIGN PATENT DOCUMENTS

| | | | |
|---|---|---|---|
| 6-91758 | 4/1994 | Japan | 264/132 |

*Primary Examiner*—Allan R. Kuhns
*Attorney, Agent, or Firm*—Collard & Roe, P.C.

[57] ABSTRACT

A slatwall section having a groove formed above and behind the upper most slat for providing additional structural integrity. The formed groove enables a slatwall to be manufactured having uniform thickness. A mating engagement between upper and lower slatwall sections provides a connection point that is concealed within a formed slat, and thereby eliminates the use of exteriorly disposed sink holes or fasteners.

6 Claims, 2 Drawing Sheets

EXTRUDED SLATWALL SECTION AND METHOD FOR MAKING THE SAME

This is a Continuation-in-Part application of U.S. patent application Ser. No. 08/726,161 filed on Oct. 4, 1996, now pending.

BACKGROUND OF THE INVENTION

1. Field of the Invention

The present invention relates to Slatwalls. More particularly, it relates to an improved design for extruded slatwalls that is easier to manufacture and provides increased strength and quality.

2. The Prior Art

Slatwalls have a front surface formed by horizontally elongated front members separated by horizontally elongated grooves. The grooves receive supports, such as braces and hangers, which, in turn, support shelves and the merchandise that is being displayed. Slatwalls are used extensively for wall displays because of the versatility that they offer as far as placement of the supports to be mounted thereon.

Often slatwalls are formed as extruded horizontally elongated sections that are interlockingly connected with similar upper and lower slatwall sections to form a slatwall panel. Generally, the upper and lower horizontal ends of the slatwall sections have connectors which mesh with those of the vertically adjacent sections to secure the sections together. Thus, several panels are used to form a slatwall. It is important that the coupling between vertically adjacent slatwall sections be such that the finished slatwall is sturdy. Furthermore, the spacing between the front slat members of the slatwall sections should be uniform to maintain an aesthetically pleasing and even appearance. In addition, the grooves in the slatwall should be designed to promote stable engagement between the slatwall and the supports that are releasably mounted within the grooves. These prior art designs utilize plastics to form the desired slatwall configuration.

SUMMARY OF THE INVENTION

According to the invention, an extruded slatwall section is provided having a body with a plurality of spaced slats for receiving hangers and other display devices. The slatwall section is formed from an extruded polyvinylchloride foam core, and has a body with an upper end and a lower end. The upper end includes a groove formed above the uppermost slat in the section such that the slatwall section has an entirely uniform thickness. The groove also forms an upper protrusion that frictionally engages the lower coupling leg of the adjacent slatwall section. The upper end also includes an upper coupling leg having a coupling bore therein.

The lower end of the slatwall section has a lower coupling leg formed by a notch in the back surface of the lower end of the section, and a coupling bore disposed therein. Upon connection of two slatwall sections the upper coupling leg of the lower slatwall section is inserted between the upper coupling leg of the lower slatwall section and the upper protrusion formed by the groove. The upper coupling leg of the lower slatwall section abuts the notch in the lower end of the upper slatwall section such that the coupling bores of the upper and lower coupling legs are axially aligned. Once aligned, a fastener of any suitable type can be inserted therethrough.

Several steps are required in order to produce the slatwall section of the invention that has superior strength and provides an aesthetically pleasing appearance. These steps include extruding a base foam core with a uniform thickness, and forming a groove above the uppermost slat to provide the uniform thickness.

Additional process steps may include performing a co-extrusion process that applies a thin (0.010"+) layer of material to the outer surface of the base foam slatwall extrusion. The co-extrusion is done at the same time as the base foamed slatwall is extruded. Co-extrusion provides a decorative coating to the extruded slatwall which includes applying different colors, and finishes to the base foamed slatwall, such as, for example, a faux wood or marble finish. The step of Co-extrusion reduces the cost of manufacturing by reducing the amount of coloring required to produce the slatwall (i.e., eliminates the need for adding colorants throughout the entire base foam slatwall compound). In addition, different compounds, other than the one used for the base foamed slatwall, can be used for the co-extrusion step to obtain different gloss levels on the outer surface. For example, an acrylic compound can be used for the co-extrusion step.

Another process step may include hot stamping the extruded slatwall section after the base foam slatwall has been extruded. Hot stamping involves applying a thin (0.0005"–0.0015") layer of material to the outer surface of the base foam slatwall extrusion. The materials applied include layers of heat sensitive adhesive, one or more layers of inks and a protective barrier top coat. The hot stamping is done as a secondary operation after extrusion. The hot stamped layers are disposed on a carrier film, and are applied to the extruded slatwall surface by applying heat and pressure to separate the layers from the carrier film to the slatwall surface. The hot stamped layers can represent any pattern or material (e.g., woods, solid colors, stones, abstract patterns, fibers, metals, etc.). The original patterns to be hot stamped are photographed and then reverse acid etched onto the printing roller printing the hot stamped film.

Another finishing process step may include wrapping the slatwall section. Wrapping involves applying a thin (0.004–0.020") layer of materials to the outer surface of the base foam slatwall extrusion. The materials applied include a layer of heat sensitive adhesive and a layer of printed plastic. The plastic layer is usually Polyvinylchloride (PVC) or polyester. The wrapping is applied with heat and pressure to the slatwall surface. Unlike hot stamping, wrapping does not include a carrier film.

An additional processing step may include buffing the outer surface of the slatwall. Buffing removes material and can burnish the outer surface to obtain different gloss levels or other pattern finishes. Buffing is a secondary operation after extrusion, and can be done either in-line or off-line with respect to the extrusion line. In order to buff the surface, the extruded slatwall is passed under a cloth cylinder treated with rouge or buffing compound. The cloth cylinder is both rotating in-line to the direction of the slatwall, and oscillating 90 degrees to the direction of the slatwall. The cylinder is also adjusted to provide a predetermined amount of pressure on the outer surface of the slatwall under the cylinder. Buffing enables any degree of gloss to be achieved (i.e., matte to high gloss), and can also provide varying degrees of a brushed type finish as typically used on metal surfaces.

It is therefore an object of the present invention to provide an improved slatwall construction of uniform thickness.

It is another object of the invention to provide a slatwall construction that includes simplified connection means for coupling several slatwall sections together.

A further object of the invention is to provide a slatwall construction that is easy to install and simple to manufacture.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1B:
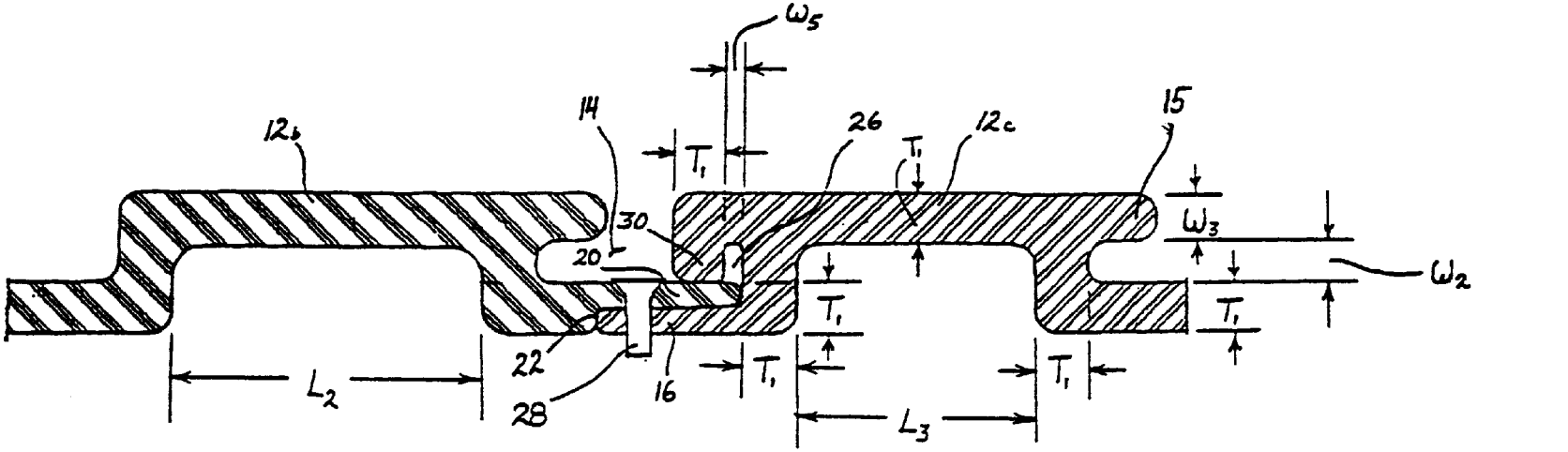
FIG. 1*b* is an enlarged cross-sectional view of the coupling of two slatwall sections according to the invention.
Figure 1A:
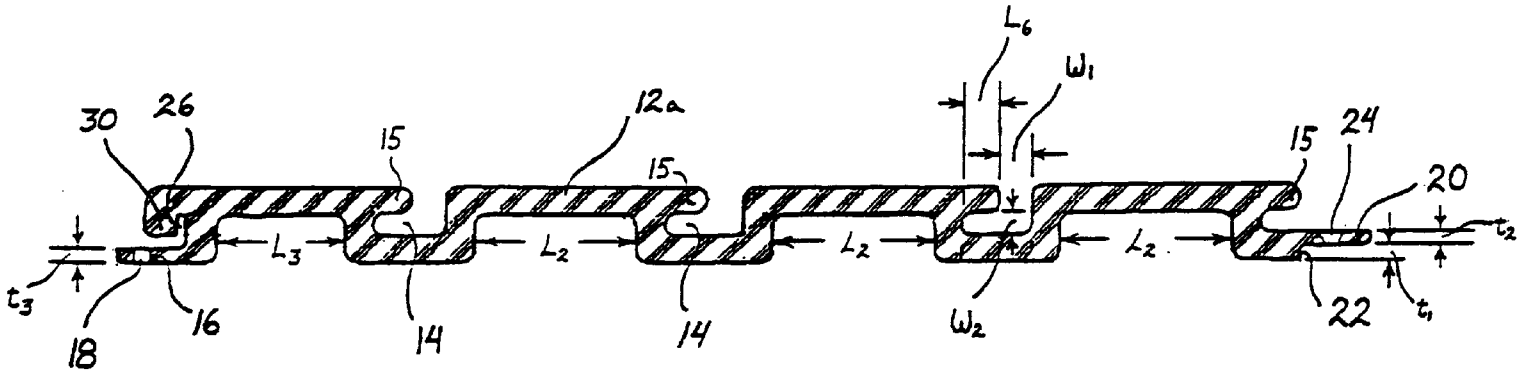
FIG. 1*a* is a cross-sectional view of the slatwall construction according to the invention.

Turning now in detail to the drawings, FIG. 1*a* shows a slatwall section 10 having a front side 12*a* with several L-shaped grooves/slats 14 for receiving the display supports (not shown). On the back side of a lower coupling leg 20, a notch 22 is provided for receiving the upper coupling leg 16 of another slatwall section. Notch 22 has approximately the same thickness $t_1$ as that of upper coupling leg 16 ($t_3$) such that when the upper coupling leg is disposed in an abutting relation with notch 22, the combined thickness ($t_1$+$t_3$) is substantially equal to the overall thickness $T_1$ of the slatwall section.

Slatwall section 10 has an upper portion/extension 30 that is formed by a groove 26 at the upper end above the upper most slat. Groove 26 has a width $w_5$ and provides additional support in the connection of two slatwall sections 12*b* and 12*c*. The provision of groove 26 enables slatwall section 10 to be molded with a uniform thickness $T_1$ throughout the entire design. The uniform thickness provides for easier manufacturing, and also increases the structural integrity of the overall slatwall construction.

Figure 2A:
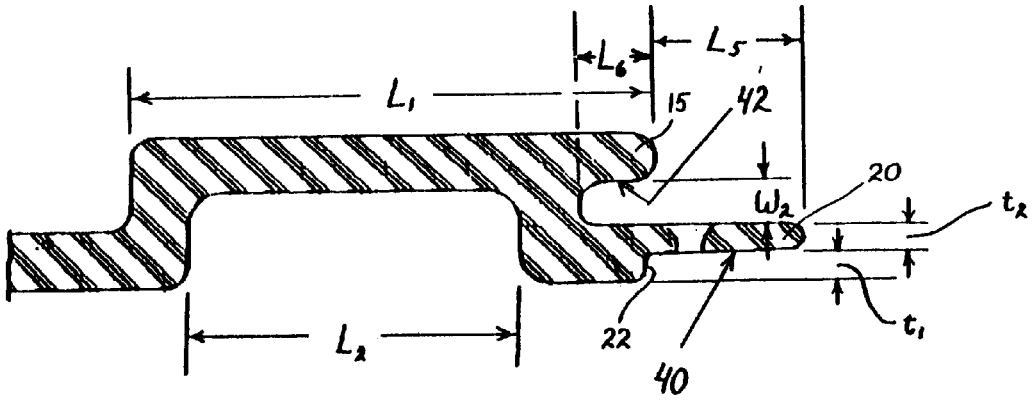
FIG. 2*a* is a detailed plan view of the lower end of the slatwall section according to the invention.

FIGS. 1*a* and 2*a* show the slats 14 having an opening width $W_1$ and an internal space width $W_2$. L-shaped slats 14 are formed by extension or lip 15 which has a length $L_6$ and width $W_3$. The width $W_3$ of lip 15 is slightly smaller than the thickness $T_1$ of the overall slatwall section. The length $L_6$ of lip 15 is of integral importance to the present invention. If $L_6$ is too small, the integrity of the slat opening is compromised, if it is too large, not only is the integrity of the slat opening decreased, but the types of display devices or supports that can be used with the slatwall are further limited. A display device or support arm (not shown) within slat opening 14 uses lip 15 to support the weight of the display device and products, and prevents the created rotational moment of the support from breaking through the slat opening. Therefore, length $L_6$ is integral in forming the slatwall. $L_6$ preferably has a range of 0.25"–0.75".

Figure 2B:
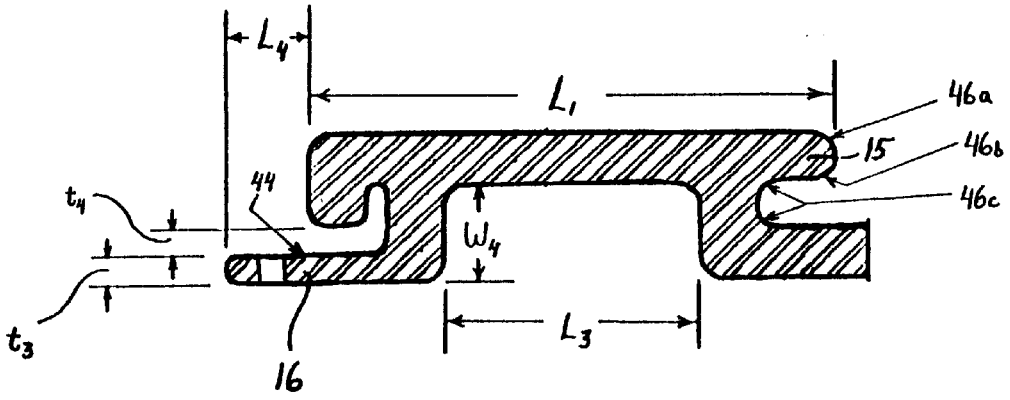
FIG. 2*b* is a detailed plan view of the upper end of the slatwall section according to the invention.

Lip 15 has external edges 46*a* and 46*b* that are rounded to help facilitate the insertion of a cantilevered hanging device into slat 14 (See FIG. 2*b*). In addition, the internal upper edges of the slats 14 have rounded edges 46*c* to further facilitate the receiving of a display hanger. The internal surface 42 of lip 15 (FIG. 2*a* ) can also be tapered to aide in the ability to receive a display hanger. Rounded edges 46*a*–46*c* have a radii in the range of 0.0625"to 0.25".

Lip 15 will be subject to outward pressure caused by the insertion of a cantilevered hanging device. As the weight of the display hanger increased, the outward pressure on lip 15 will increase. Thus, lip 15 must be capable of withstanding pressure caused by display hangers. As such, lip 15 will have a very slight freedom of flexibility when subject to external pressure. The use of rounded edges 46*a*–46*c* significantly effect and increase the strength of lip 15. When using squared edges, especially within slat opening 14, stress points are created at the squared corners resulting in cracks and inability to support. Thus, when lip 15 is subject to outward pressure, the tendency for breakage at a squared corner is significantly higher. By rounding edges 46*c*, the stress points are distributed along the curved or rounded portions and as such are significantly less than would be with squared edges. The rounded edges 46*a* and 46*b* on the external portions of lip 15 increase the ability to receive display hangers and other support devices into the slat opening 14, and further provide a pleasing aesthetic appearance.

FIG. 1*b* shows the coupling of two slatwall sections 12*b* and 12*c* using a fastener 28. The upper coupling leg 16 of slatwall 12*c* is matingly joined with the lower coupling leg 20 of slatwall section 12*b* by driving the fastener through legs 16 and 20 so that they are axially aligned with each other, and leg 16 abuts notch 22. Once positioned such that holes 18 and 24 are axially aligned, fastener 28 is inserted therethrough to secure the connection between slatwall sections. Lower coupling leg 20 frictionally engages upper coupling leg 16 and extension 30 of the lower slatwall section 12*c*. This frictional engagement further increases the overall structural integrity of the connection between the two slatwall sections and therefore, the entire slatwall. The connection of the two slatwall sections 12*b* and 12*c* form a slat 14 for receiving display mounts. Thus, a uniform aesthetic appearance of the overall slatwall construction is achieved.

The placement of holes 18 and 24 in the overlapping leg portions 16 and 20, respectively, forms the connection point of the two slatwall sections within slat 14. This eliminates the potential of sink holes. Fastener 28 can be any suitable known fastener for securing slatwall sections to each other and the structure on which they are mounted.

The thickness $T_1$ of the slatwall sections is uniform throughout the entire design with the exception of width $W_3$ of extension 15. The disposition of groove 26 at the upper end provides upper portion/extension 30 with the same thickness $T_1$ as the remaining parts of the slatwall construction. The width $w_5$ of groove 26 is variable in accordance with the design specifications of the slatwall to assure uniform thickness of the entire slatwall. The combined thickness of upper coupling leg 16 with lower coupling leg 20 (i.e., $t_1$+$t_3$) is substantially equal to the uniform thickness $T_1$ of the slatwall.

FIG. 2*a* shows a detailed view of the lower coupling leg 20 of the slatwall section. Leg 20 has a surface 40 that is tapered or slightly sloped toward notch 22. In a preferred embodiment, surface 40 is tapered at 2°. The distance between slat openings is defined by $L_1$. The distance $L_1$ is uniform across the entire slatwall section. On the underside of the slatwall section, there are cutouts defined by the slats 14 (FIG. 1*a*). These cutouts all have a length $L_2$ with the exception of the uppermost cutout adjacent upper coupling leg 16. The upper most cutout has a shortened length $L_3$ to accommodate the addition of upper extension 30. All of the cutouts have the same width $W_4$.

FIG. 2*b* shows a detailed view of the upper coupling leg 16. Coupling leg 16 has an upper surface 44 that is complimentarily tapered or sloped with respect to the tapered surface 40 of lower coupling leg 20. Surface 40 is preferably tapered at 2°.

In a particular embodiment of the invention, the uniform thickness $T_1$=0.29", and other measurements $W_3$=0.27", $W_2$=0.23", $W_1$=0.35", and $L_6$=0.4". The distance $L_1$ between slats, and thereby the underside openings $L_2$ and $L_3$ are variable according to design. In the embodiment of FIG. 1*a*, $L_1$=2.65", $L_2$=1.67"and $L_3$=1.28". The width $W_4$ of the openings is equal to 0.5". Theses measurements are examples of one configuration. The uniform thickness $T_1$ is one of the many measurements that provide for a superior extruded slatwall. $T_1$ can be within a range of 0.15"–0.5".

The thicknesses of the coupling legs 16 and 20 is of integral importance in the design of the slatwall section. Thickness $t_1$=0.14"±0.005"at the inside by notch 22, and 0.16" ±0.005 at the end (considering the 2° taper of surface 40), $t_2$=0.13"±0.005", $t_3$=0.13"±0.005"at the very end of leg 16, and 0.15"±0.005" at the inside adjacent groove 26 (considering the 2° taper of surface 40). The length $L_5$ has a range of 0.65"–0.75" and the length $L_4$ has a range of 0.3"–0.4".

Slatwall sections 12 can be made from any known material such as, for example, plastics, metals, alloys, and any other suitable known material. For purposes of this invention, the preferred material is a formulation of foamed Polyvinylchloride (PVC).

The method of making the slatwall section requires several steps including molding the slatwall section with a uniform thickness. In order to do this, groove 26 is formed above and behind the upper most slat of the slatwall section. In addition, notch 22 is formed in the lower end of the slatwall section for receiving the upper coupling leg 16 of another slatwall section such that the combined thickness of the coupled ends is substantially equal to the uniform thickness $T_1$ of the entire slatwall section. The base foam material that is extruded to form the slatwall has a specific gravity within a range of 0.4–0.8. Any other specific gravity value outside this range would make the base foam material for extrusion un-usable.

Additional processing steps for manufacturing the slatwall according to the invention, are a co-extrusion process that applies a thin (0.010"+) layer of material to the outer surface of the base foam slatwall extrusion. The co-extrusion is done at the same time as the base foamed slatwall is extruded. Co-extrusion provides a decorative coating to the extruded slatwall which includes applying different colors, and finishes to the base foamed slatwall, such as, for example, a faux wood or marble finish.

Another process step includes hot stamping the extruded slatwall section after the base foam slatwall has been extruded. Hot stamping involves applying a thin (0.0005"–0.0015") layer of material to the outer surface of the base foam slatwall extrusion. The materials applied include layers of heat sensitive adhesive, one or more layers of inks and a protective barrier top coat. The hot stamping is done as a secondary operation after extrusion. The hot stamped layers are disposed on a carrier film, and are applied to the extruded slatwall surface by applying heat and pressure to separate the layers from the carrier film to the slatwall surface. The hot stamped layers can represent any pattern or material (e.g., woods, solid colors, stones, abstract patterns, fibers, metals, etc.). The original patterns to be hot stamped are photographed and then reverse acid etched onto the printing rollers which print the hot stamped film.

Another finishing process step includes wrapping the slatwall section. Wrapping involves applying a thin (0.004–0.020") layer of materials to the outer surface of the base foam slatwall extrusion. The materials applied include a layer of heat sensitive adhesive and a layer of printed plastic. The plastic layer is usually Polyvinylchloride (PVC) or polyester. The wrapping is applied with heat and pressure to the slatwall surface. Unlike hot stamping, wrapping does not include a carrier film.

An additional processing step includes buffing the outer surface of the slatwall. Buffing removes material and can burnish the outer surface to obtain different gloss levels or other textured finishes.

While one embodiment of the present invention have been shown and described, it is to be understood that many changes and modifications may be made thereunto without departing from the spirit and scope of the invention as defined in the appended claims.

What is claimed is:

1. An extruded slatwall section comprising:

a body having a front, a back, a top and a bottom;

a plurality of spaced slats for receiving hangers and other display devices, each of said slats comprising an opening in said front of said body, and an L-shaped aperture extending from said opening;

a lip integrally formed with each of said slots and being disposed above and adjacent said opening, said lip having a rounded outer surface extending into said opening;

an upper portion formed in the body above the slat closest to the top of the body, said upper portion having a groove formed therein, such that the entire body has a uniform thickness.

2. The extruded slatwall section according to claim 1, wherein said L-shaped aperture is integrally formed with said body and includes an aperture behind said lip, said aperture having rounded edges for providing additional strength to said slats for retaining hangers and display devices.

3. The extruded slatwall section according to claim 1, wherein said body is extruded from a base foam core having a specific gravity within the range of 0.4–0.8, said slatwall body having a dense outer surface and a foamed core having variable densities.

4. The extruded slatwall section according to claim 3, wherein the outer surface of said slatwall body is co-extruded by applying a thin layer of material to the outer surface of the section.

5. The extruded slatwall section according to claim 4, wherein a thin layer of material is hot stamped onto the slatwall section to provide a different aesthetic appearance to the slatwall surface.

6. The extruded slatwall section according to claim 5, further comprising a hot stamped layer applied to a carrier film, disposing the carrier film over the slatwall section so that when the carrier film is heated under pressure, the hot stamp layer will separate from the carrier film and adhere to the surface of the extruded slatwall surface.

* * * * *